US010619642B2

(12) United States Patent
Horng et al.

(10) Patent No.: US 10,619,642 B2
(45) Date of Patent: Apr. 14, 2020

(54) FAN FRAME AND FAN INCLUDING THE SAME

(71) Applicant: Sunonwealth Electric Machine Industry Co., Ltd., Kaohsiung (TW)

(72) Inventors: Alex Horng, Kaohsiung (TW); Chia-Ching Tsai, Kaohsiung (TW); Hung-Cheng Zhou, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 5 days.

(21) Appl. No.: 15/871,259

(22) Filed: Jan. 15, 2018

(65) Prior Publication Data

US 2019/0085855 A1 Mar. 21, 2019

(30) Foreign Application Priority Data

Sep. 20, 2017 (TW) ..... 106132286 A

(51) Int. Cl.
*F04D 29/00* (2006.01)
*F04D 19/00* (2006.01)
(Continued)

(52) U.S. Cl.
CPC ..... *F04D 29/005* (2013.01); *F04D 19/002* (2013.01); *F04D 25/0613* (2013.01);
(Continued)

(58) Field of Classification Search
CPC ..... F04D 29/00; F04D 29/005; F04D 29/023; F04D 29/053; F04D 29/522;
(Continued)

(56) References Cited

U.S. PATENT DOCUMENTS 6,790,003 B1 9/2004 Hu et al.
8,092,155 B2 * 1/2012 Tsen ..... F04D 25/0613 415/118
(Continued)

FOREIGN PATENT DOCUMENTS

CN 205117765 U * 3/2016
CN 205117765 U 3/2016
(Continued)

*Primary Examiner* — Moshe Wilensky
*Assistant Examiner* — Andrew Thanh Bui
(74) *Attorney, Agent, or Firm* — Alan D. Kamrath; Karin L. Williams; Mayer & Williams PC

(57) ABSTRACT

A fan frame includes a housing, a shaft tube, a circuit board and a plurality of light-emitting elements. The housing includes a base and a plurality of connection members located between the base and a peripheral wall of the housing. The shaft tube is mounted on the base. The circuit board is mounted in the housing and includes a body having a through-hole. The circuit board is fit around the shaft tube via the through-hole and is integrally formed with a plurality of protruding ribs and at least one outer rib. Each protruding rib is aligned with a respective connection member. Each outer rib is located between two adjacent protruding ribs. The light-emitting elements are mounted on the protruding ribs and the outer rib. A fan including the fan frame is also disclosed.

24 Claims, 8 Drawing Sheets

(51) Int. Cl.

| | |
|---|---|
| ***F04D 29/02*** | (2006.01) |
| ***F04D 29/053*** | (2006.01) |
| ***F04D 25/06*** | (2006.01) |
| ***F04D 29/52*** | (2006.01) |

(52) U.S. Cl.
CPC ..... *F04D 25/0693* (2013.01); *F04D 29/023* (2013.01); *F04D 29/053* (2013.01); *F04D 29/522* (2013.01)

(58) Field of Classification Search
CPC .... F04D 19/002; F04D 25/08; F04D 25/0613; F04D 25/0693
USPC ..... 415/213.1
See application file for complete search history.

(56) References Cited

U.S. PATENT DOCUMENTS

| | | | | |
|---|---|---|---|---|
| 2006/0012973 | A1 | 1/2006 | Lin | |
| 2007/0096570 | A1 | 5/2007 | Lin et al. | |
| 2018/0187689 | A1* | 7/2018 | Chen | F04D 27/004 |
| 2018/0231241 | A1* | 8/2018 | Hung | F21V 33/0096 |

FOREIGN PATENT DOCUMENTS

| | | | |
|---|---|---|---|
| DE | 202005019695 | U1 | 2/2006 |
| TW | M444697 | U | 1/2013 |
| TW | M492968 | U | 1/2015 |
| TW | M547239 | U | 8/2017 |

* cited by examiner

FAN FRAME AND FAN INCLUDING THE SAME

CROSS REFERENCE TO RELATED APPLICATION

The application claims the benefit of Taiwan application serial No. 106132286, filed on Sep. 20, 2017, and the contents of which are incorporated herein by reference.

BACKGROUND OF THE INVENTION

1. Field of the Invention

The present invention generally relates to a fan frame and, more particularly, to a fan frame that can generate a glaring visual effect.

2. Description of the Related Art

In addition to providing the cooling function, a conventional cooling fan may further include a plurality of light-emitting diodes (LEDs) that generate a glaring visual effect during operation of the cooling fan, so as to provide a pleasant visual effect. This provides added value of the product and increases the user's likelihood to purchase the fan. In the conventional cooling fan, a plurality of light-emitting elements are mounted on a fan frame of the cooling fan to provide a light-emitting effect. An example of such a cooling fan is disclosed in Taiwan Patent No. M444697.

Although the conventional cooling fan can provide a cooling function and a light-emitting function at the same time, the emitted light is completely blocked in an axial direction, leading to insufficient illuminance of the light-emitting elements.

In light of this, it is necessary to improve the conventional cooling fan.

SUMMARY OF THE INVENTION

It is therefore an objective of this invention to provide a fan frame where the light generated by the light-emitting elements can provide different glaring visual effects.

It is another objective of this invention to provide a fan including a fan frame where the light generated by the light-emitting elements can provide different glaring visual effects.

In one aspect, a fan frame includes a housing, a shaft tube, a circuit board and a plurality of light-emitting elements. The housing includes a base and a plurality of connection members located between the base and a peripheral wall of the housing. The shaft tube is mounted on the base. The circuit board is mounted in the housing and includes a body having a through-hole. The circuit board is fit around the shaft tube via the through-hole and is integrally formed with a plurality of protruding ribs and at least one outer rib. Each of the plurality of protruding ribs is aligned with a respective one of the plurality of connection members. Each of the at least one outer rib is located between two adjacent ones of the plurality of protruding ribs. The plurality of light-emitting elements is mounted on the plurality of protruding ribs and the at least one outer rib.

In another aspect, a fan frame includes a housing, a base, a circuit board and a plurality of light-emitting elements. The housing includes a plurality of first coupling portions on a side thereof. The base includes a plurality of connection members. Each of the plurality of connection members includes a free end having a second coupling portion coupled with a respective one of the plurality of first coupling portions. The circuit board includes a body and is integrally formed with a plurality of protruding ribs and at least one outer rib. Each of the plurality of protruding ribs is aligned with a respective one of the plurality of connection members. Each of the at least one outer rib is located between two adjacent ones of the plurality of protruding ribs. The plurality of light-emitting elements is mounted on the plurality of protruding ribs and the at least one outer rib.

In a further aspect, a fan frame includes a housing, a shaft tube, a circuit board, a plurality of light-emitting elements and a plurality of light-guiding members. The housing includes a base, a plurality of connection members, and a peripheral wall having a plurality of notches radially aligned with the plurality of connection members, respectively. The shaft tube is mounted on the base. The circuit board is mounted in the housing and includes a body having a through-hole. The circuit board is fit around the shaft tube via the through-hole and is integrally formed with a plurality of protruding ribs. Each of the plurality of protruding ribs is aligned with a respective one of the plurality of connection members and extends into a respective one of the plurality of notches. Each of the plurality of protruding ribs includes a portion extending into the respective one of the plurality of notches and mounted with one of the plurality of light-emitting elements, as well as another portion adjoining the body and mounted with another of the plurality of light-emitting elements. Each of the plurality of light-guiding members is aligned with the one of the plurality of light-emitting elements located in the respective one of the plurality of notches.

In a still further aspect, a fan includes the fan frame and a transparent impeller.

Based on this, the circuit board in the fan frame and the fan including the same is integrally formed with the protruding ribs and at least one outer rib where the light-emitting elements are mounted. In this regard, the light-emitting elements are not completely blocked by other structure in the axial direction thereof. Particularly, the light-emitting elements can render different glaring visual effects during the rotation of the impeller in addition to the cooling function as originally provided. This can not only bring more businesses to the industry but also provide a higher utility and an aesthetic effect.

In an example, each of the plurality of first coupling portions is an engaging hole, and each of the plurality of second coupling portions is an engaging peg. Thus, easy assembly is provided.

In another example, each of the plurality of first coupling portions is an engaging peg, and each of the plurality of second coupling portions is an engaging hole. Thus, easy assembly is provided.

In an example, the fan frame further includes a plurality of fasteners. Each of the plurality of first coupling portions is in a form of a hole, and each of the plurality of second coupling portions is also in a form of a hole. The plurality of fasteners respectively extends through the first coupling portions and the plurality of second coupling portions. Thus, easy assembly is provided.

In an example, the at least one outer rib forms at least one ring. In this arrangement, a more pleasant visual effect can be provided.

In an example, each of the plurality of protruding ribs has a length smaller than or equal to a length of the respective one of the plurality of connection members. Thus, the mounting operation is convenient.

In an example, each of the plurality of protruding ribs has a width smaller than or equal to a width of the respective one of the plurality of connection members. Thus, the mounting operation is convenient and the air paths are not blocked.

In an example, a quantity of the plurality of protruding ribs is smaller than or equal to a quantity of the plurality of connection members. Thus, the mounting operation is convenient.

In an example, the plurality of light-emitting elements is mounted on the circuit board at regular intervals. In this arrangement, the light sources are uniformly arranged.

In an example, the plurality of light-emitting elements includes at least two kinds of colors of light sources. Thus, a more pleasant visual effect can be provided.

In an example, the plurality of light-emitting elements is made of foggy acrylic, polycarbonate or optical fiber. Thus, a halo-like pattern is generated.

In an example, the plurality of light-emitting elements includes a plurality of light-emitting diodes. The plurality of light-emitting diodes includes three primary colors of light comprising red, green and blue colors. Thus, various combinations of colors of light are provided.

In an example, the circuit board is integrally formed with at least one outer rib, and each of the at least one outer rib is located between two adjacent ones of the plurality of protruding ribs. In this arrangement, a more pleasant visual effect can be provided.

In an example, each of the plurality of notches is located on a respective one of a plurality of corners of the housing. In this arrangement, the assembly is more secure.

In an example, the circuit board and the base are integrally formed with each other. Thus, the required assembly cost and time are reduced.

In an example, the circuit board includes a motor drive control circuit 7 and a light-emitting diode (LED) control circuit 8. In this arrangement, the lighting operation of the light-emitting elements can be controlled.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
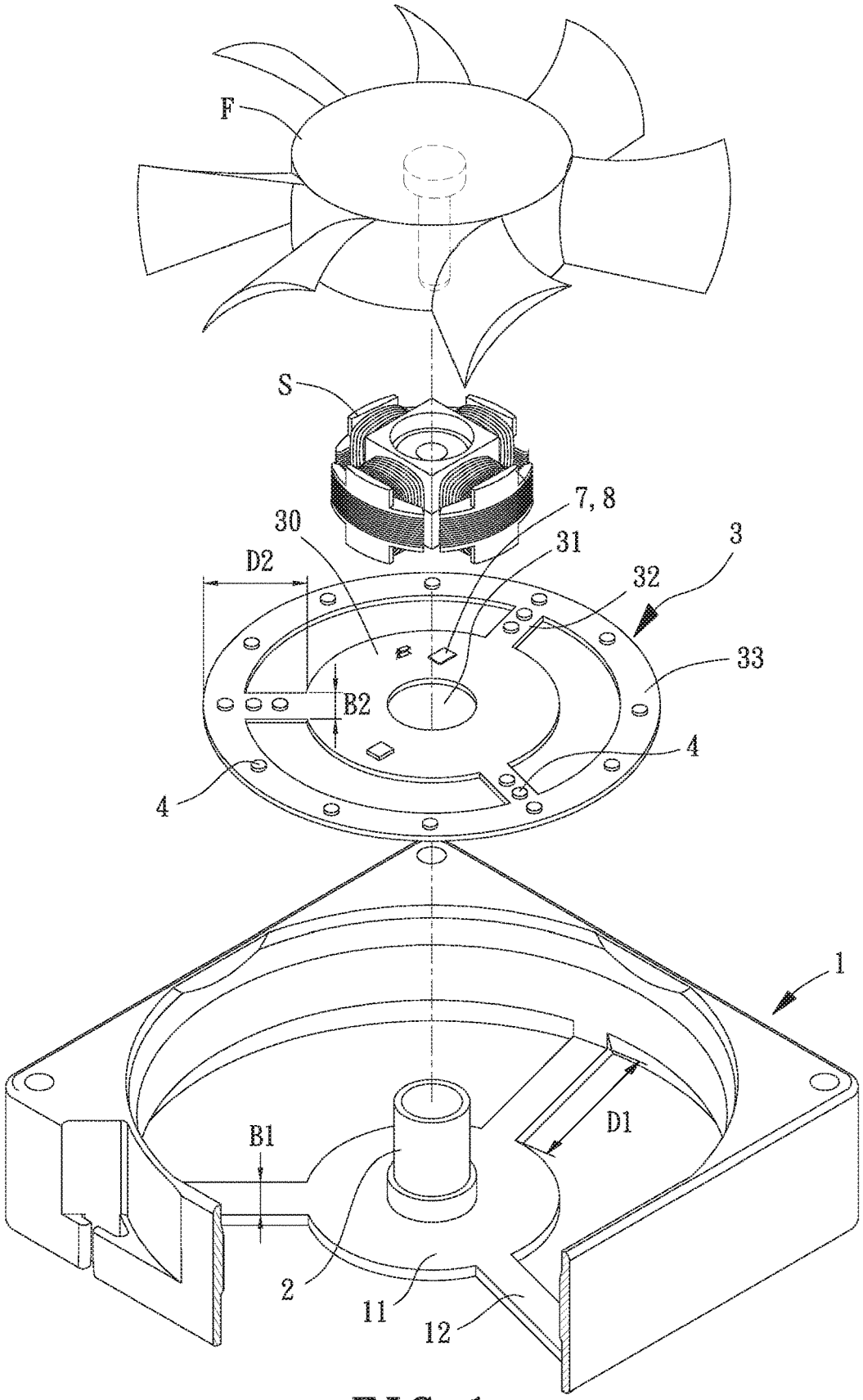
FIG. 1 is an exploded, perspective view of a fan including a fan frame of a first embodiment according to the invention.

In the various figures of the drawings, the same numerals designate the same or similar parts. Furthermore, when the terms "first", "second", "inner", "outer", "radial", "axial", "length", "width" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

FIG. 1 shows a fan including a fan frame of a first embodiment according to the invention. The fan frame is used to couple with a stator S and an impeller F which is transparent or translucent. The fan frame includes a housing 1, a shaft tube 2 coupled with the housing 1, a circuit board 3 fit around the shaft tube 2, and a plurality of light-emitting elements 4 mounted on the circuit board 3.

Referring to FIG. 1, the housing 1 includes a base 11 and a plurality of connection members 12 extending in radial directions. The connection members 12 are located between the base 11 and the housing 1.

Referring to FIG. 1, the shaft tube 2 is mounted at a center of the base 11 in the housing 1 and is coupled with the stator S. The impeller F is rotatably coupled with the shaft tube 2.

Referring to FIG. 1. The circuit board 3 includes a body 30 having a through-hole 31 and fits around the shaft tube 2 through the through-hole 31. The circuit board 3 is integrally formed and includes a plurality of protruding ribs 32 and at least one outer rib 33. In this embodiment, the at least one outer rib 33 extends in a circumferential direction. The body 30 is coupled with the base 11. Each of the protruding ribs 32 covers a respective connection member 12. Each of the protruding ribs 32 has a length D2 which is smaller than or equal to a length D1 of the connection member 12. Each of the protruding ribs 32 has a width B2 which is smaller than or equal to a width B1 of the connection member 12. Each of the protruding ribs 32 includes an inner end relatively adjacent to the through-hole 31 and an outer end relatively distant to the through-hole 31. Each outer rib 33 is connected between the outer ends of two protruding ribs 32. Since the connection members 12 are connected between the base 11 and the housing 1, the protruding ribs 32 and the at least one outer rib 33 are also located between the base 11 and the housing 1.

Figure 2:
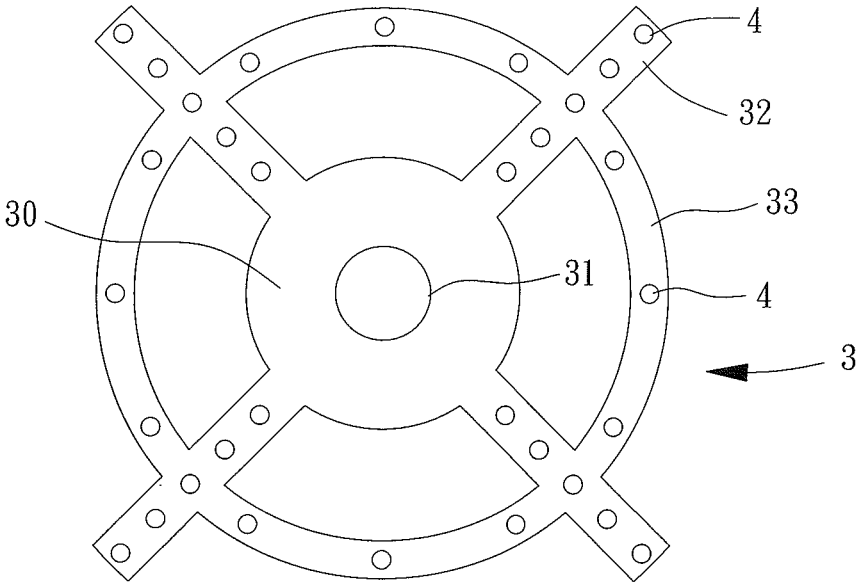
FIG. 2 shows a top view of an example of a circuit board of the fan frame of the first embodiment according to the invention.

Referring to FIG. 1, it is particularly noted that the quantity of the protruding ribs 32 is smaller than or equal to that of the connection members 12. In other words, when there are three connection members 12, there are three or two protruding ribs 32. In this embodiment, there are three protruding ribs 32. If there are four protruding ribs 32 (as shown in FIG. 2), there are four or more connection members 12. The invention is not limited to either option. Furthermore, the circuit board 3 and the base 11 are coupled with each other by assembly or integral formation. The circuit board 3 includes a motor drive control circuit 7 and a light-emitting diode (LED) control circuit 8.

Figure 3:
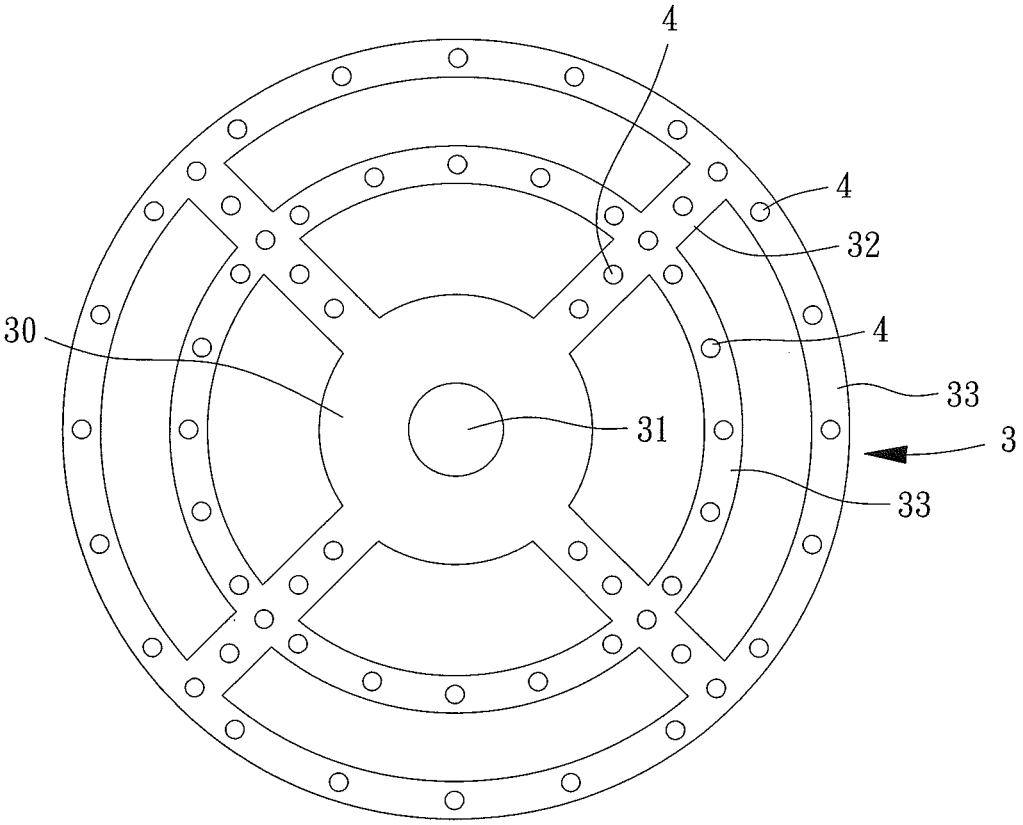
FIG. 3 shows a top view of another example of the circuit board of the fan frame of the first embodiment according to the invention.
Figure 4:
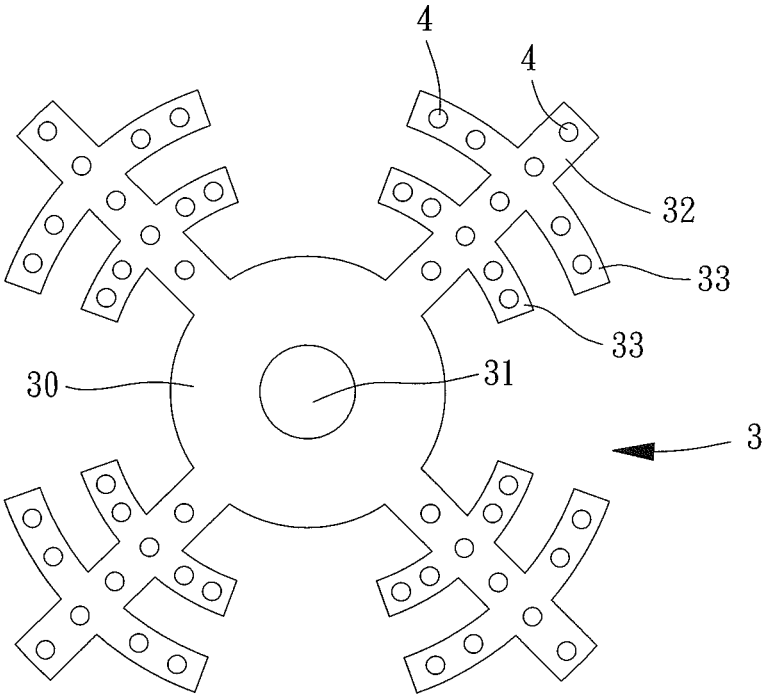
FIG. 4 shows a further implementation of the circuit board of the fan frame of the first embodiment according to the invention.

Furthermore, the quantity of the at least one outer rib 33 is one or more than one. In this embodiment, the at least one outer rib 33 includes three outer ribs 33 which form a ring, as shown in FIG. 1. Alternatively, the at least one outer rib 33 includes eight outer ribs 33 which form two rings, as shown in FIG. 3. Still alternatively, the at least one outer rib 33 includes eight disconnected outer ribs 33. In this case, the outer ribs 33 can form a pattern resembling two incomplete circles as shown in FIG. 4.

Figure 5:
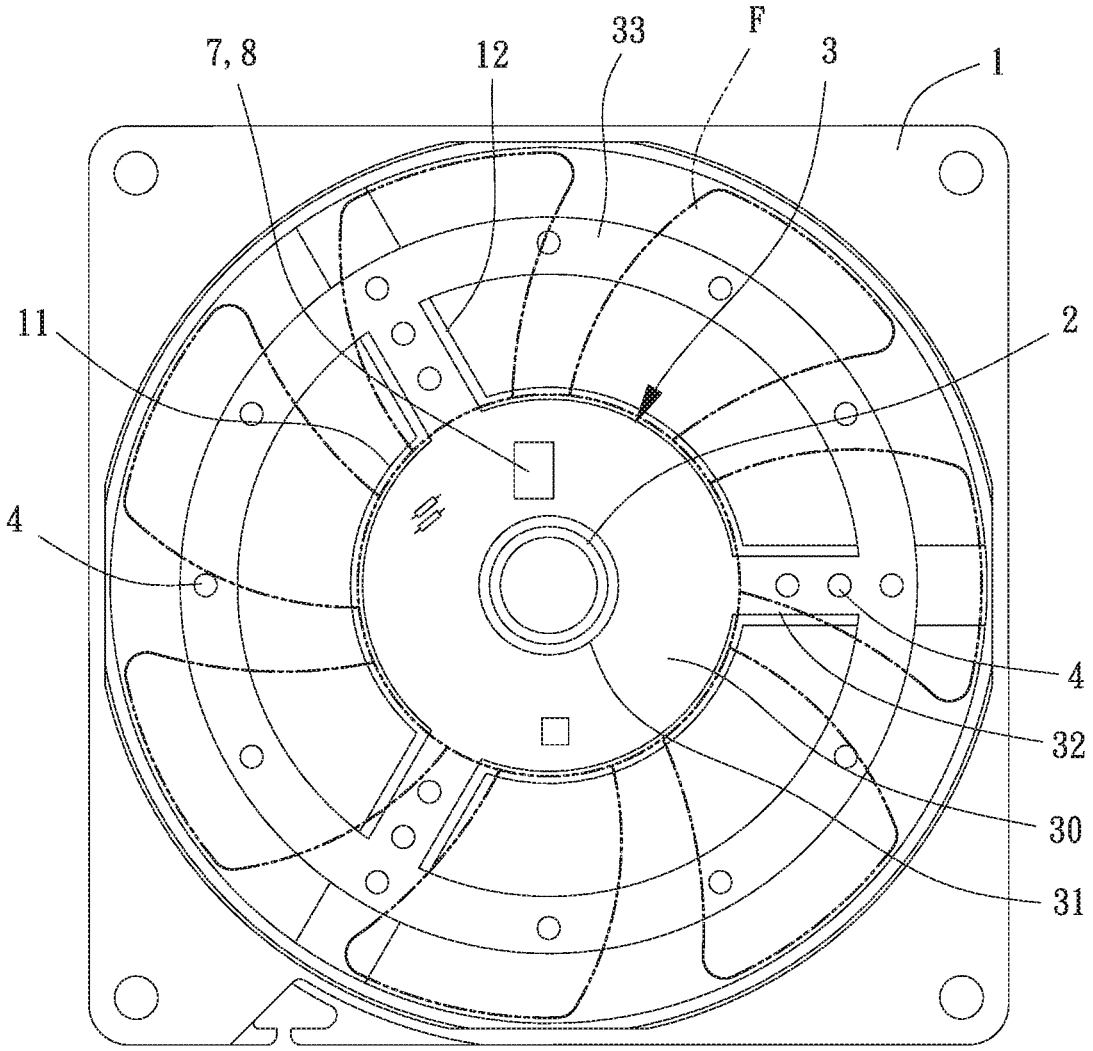
FIG. 5 is a top, assembled view of the fan of FIG. 1 without the stator.

Referring to FIGS. 1 and 5, the light-emitting elements 4 are mounted on the circuit board 3. Namely, each of the protruding ribs 32 is mounted with at least one light-emitting element 4, and each of the outer ribs 33 is also mounted with at least one light-emitting element 4. The light-emitting elements 4 are electrically connected to the circuit board 3 and are spaced from each other at regular intervals. Since the protruding ribs 32 and the outer ribs 33 are located between the base 11 and the housing 1, the light-emitting elements 4 are also located between the base 11 and the housing 1. Also, the light-emitting elements 4 are located within a rotation range of the impeller F (as shown in FIG. 5). The light-emitting elements 4 include at least two kinds of colors of light sources to generate different colors of light. In an example, the light-emitting elements 4 include the LEDs having the primary colors of light (red, green and blue colors) in order to generate various combinations of colors of light.

Referring to FIGS. 1 and 5, based on the above structure, the light-emitting elements 4 are mounted on the protruding ribs 32 and the at least one outer rib 33. Moreover, the light-emitting elements 4 are located within the rotation range of the impeller F, such that the light-emitting elements 4 are not completely blocked by other structure in the axial direction thereof. Particularly, the light-emitting elements 4 can render different glaring visual effects during the rotation of the impeller F in addition to the cooling function as originally provided. This can not only bring more businesses to the industry but also provide a higher utility and an aesthetic effect.

Figure 6:
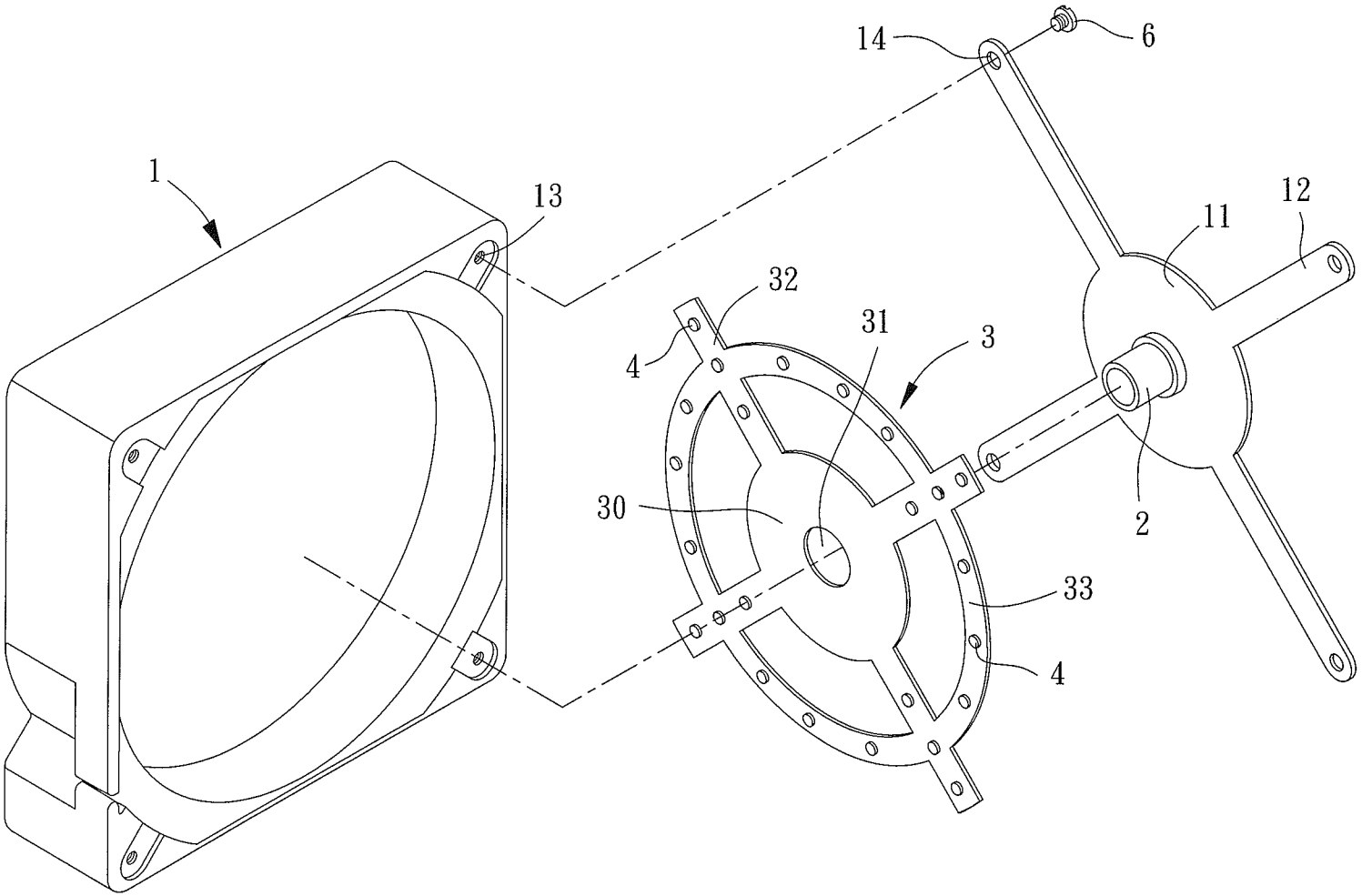
FIG. 6 is an exploded, perspective view of a fan frame of a second embodiment according to the invention.

FIG. 6 shows a fan frame of a second embodiment according to the invention. The second embodiment is substantially the same as the first embodiment above except for that the circuit board 3 and the base 11 can be assembled outside of the housing 1 for convenient assembly. The housing 1 is not integrally formed with the base 11. A side of the housing 1 includes a plurality of first coupling portions 13. Each of the connection members 12 includes a free end having a second coupling portion 14. During the assembly, the circuit board 3 is fit around the shaft tube 2 via the through-hole 31 to couple the body 30 with the base 11. Each of the protruding ribs 32 is axially aligned and coupled with a respective connection member 12 by adhesion, engagement or other methods. Then, the second coupling portions 14 are coupled with the first coupling portions 13, respectively.

Referring to FIG. 6, the coupling mechanism between the second coupling portions 14 and the first coupling portions 13 is not limited. In this embodiment, each of the first coupling portions 13 is in the form of a hole, and each of the second coupling portions 14 is also in the form of a hole. In this regard, a fastener 6 extends through each pair of the first coupling portion 13 and the second coupling portion 14 to fix the connection members 12 in the housing 1. The fastener 6 is a screw or a rivet. In addition, each pair of the first coupling portion 13 and the second coupling portion 14 can have other engagement structure. For example, the first coupling portion 13 is an engaging hole, and the second coupling portion 14 is an engaging peg to engage with the engaging hole. Alternatively, the first coupling portion 13 is an engaging peg, and the second coupling portion 14 is an engaging hole to be engaged by the engaging peg.

Referring to FIG. 6, based on the above structure, each second coupling portion 14 is coupled with a respective first coupling portion 13 to provide a convenient assembly. Also, since the light-emitting elements 4 are mounted on the protruding ribs 32 and the at least one outer rib 33, the light-emitting elements 4 are located within the rotation range of the impeller F. Therefore, the light-emitting elements 4 are not completely blocked by other structure in the axial direction. Particularly, the light-emitting elements 4 can render different glaring visual effects during the rotation of the impeller F (as shown in FIG. 1) in addition to the cooling function as originally provided.

Figure 7:
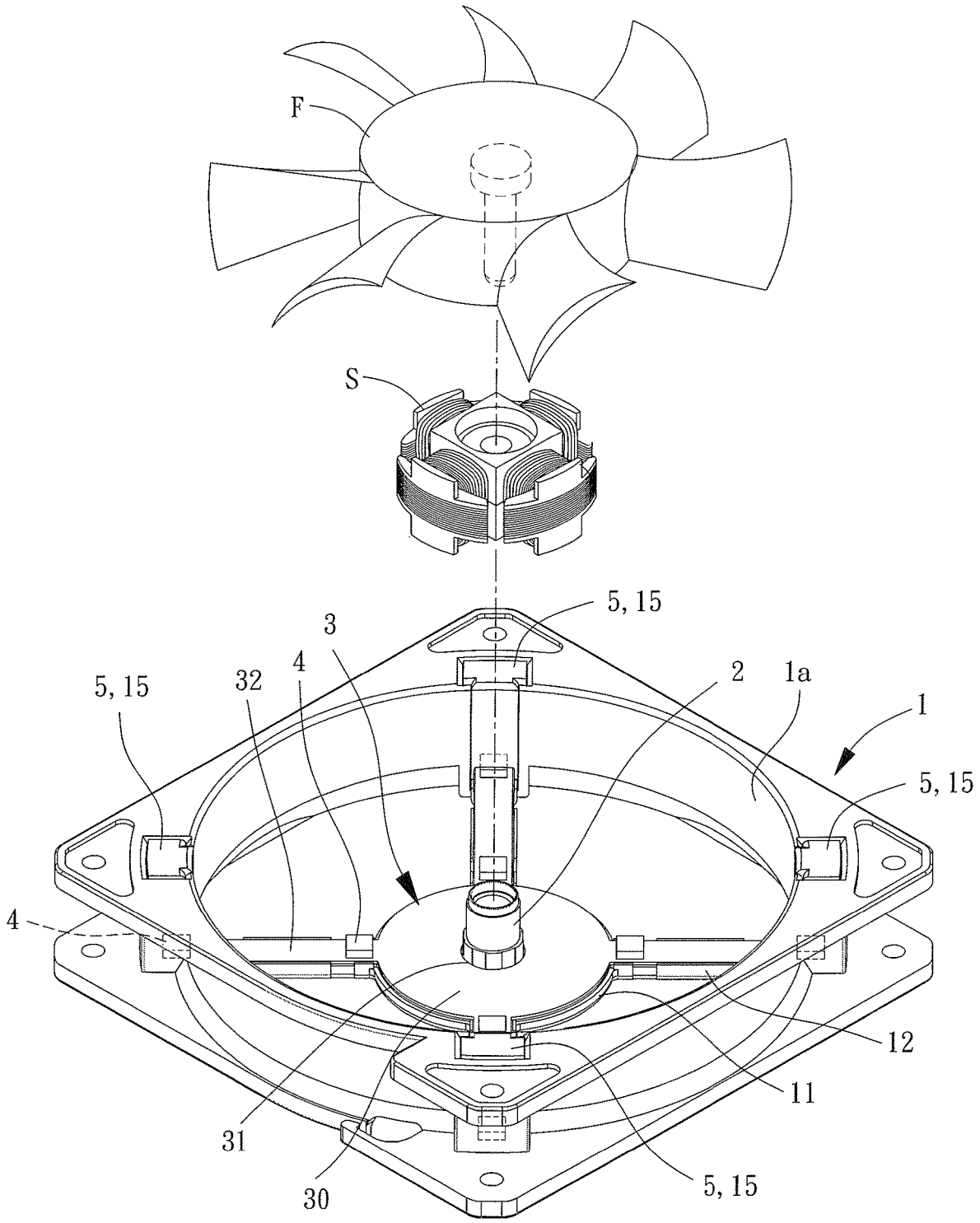
FIG. 7 is a partially-exploded, perspective view of a fan including a fan frame of a third embodiment according to the invention.
Figure 8:
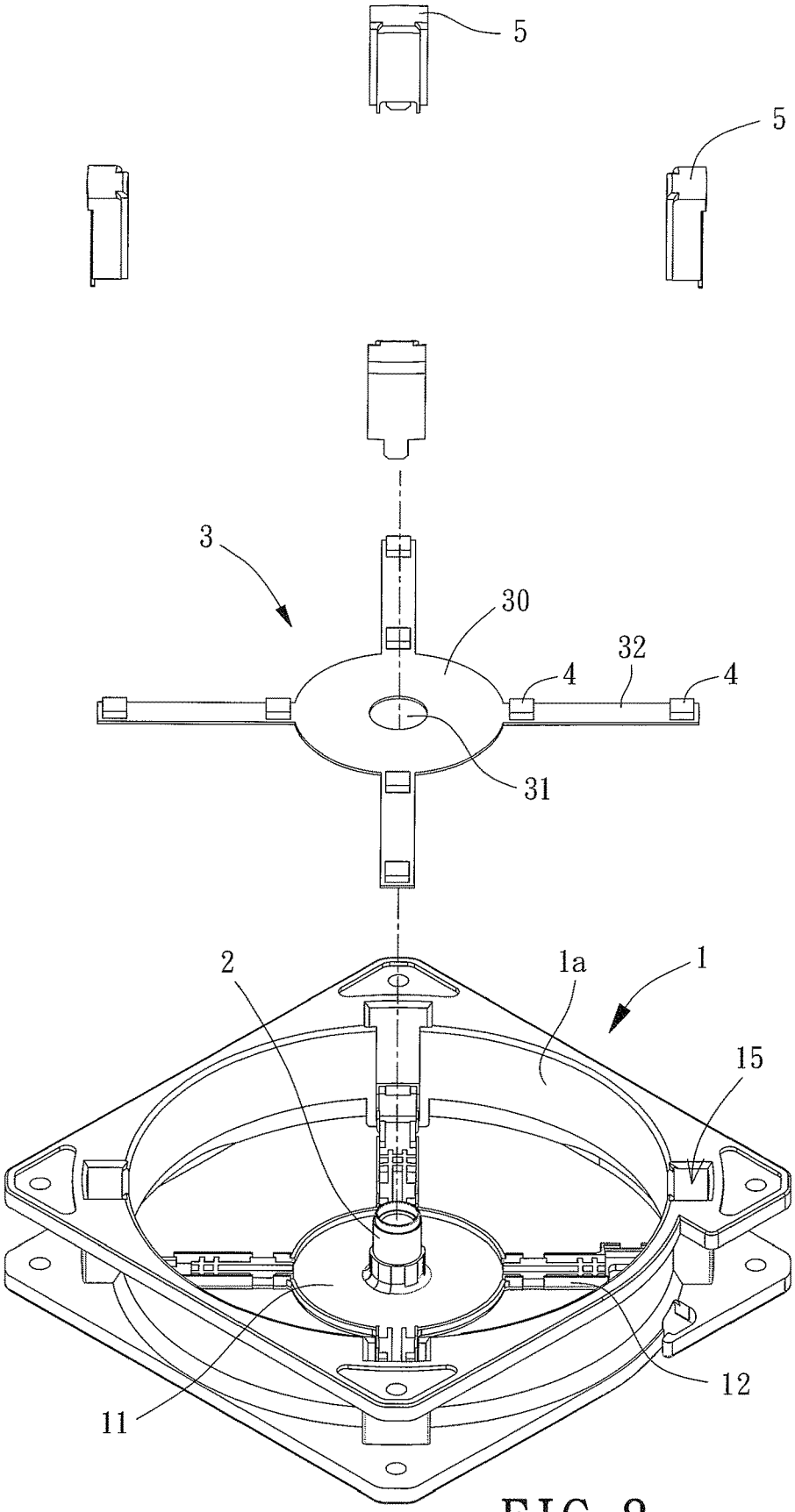
FIG. 8 is an exploded, perspective view of the fan frame shown in FIG. 7 where the circuit board, plural light-emitting elements and plural light-guiding members are separate from the housing.

FIGS. 7 and 8 show a fan including a fan frame of a third embodiment according to the invention. The third embodiment is substantially the same as the first embodiment above except for that the housing 1 further includes a peripheral wall 1*a* having a plurality of notches radially aligning with the plurality of connection members 12, respectively. Each of the notches 15 is located on a corner of the housing 1. Each of the protruding ribs 32 axially aligns and covers a respective connection member 12 and extends to a respective a notch 15. Each of the protruding ribs 32 is mounted with at least two light-emitting elements 4. Each of the two ends of the protruding rib 32 is mounted with one light-emitting element 4. Namely, one of the at least two light-emitting elements 4 is mounted on the portion of the rib 32 extending into the notch while another of the at least two light-emitting elements 4 is mounted on the portion of the rib 32 adjoining the body 30. The fan frame further includes a plurality of light-guiding members 5. Each of the light-guiding members 5 covers a respective light-emitting element 4 located in the notch 15.

Referring to FIGS. 7 and 8, the light-guiding members 5 are made of a material such as a foggy acryl, polycarbonate or optical fiber. The light of the light-emitting elements 4 transmits through the light-guiding members 5 to produce a halo-like pattern or different colors of light for decoration without causing a dazzling effect resulting from the direct incidence of the light to the user's eyes. Furthermore, the light-guiding members 5 that have different colors of light are used to generate different colors of light.

Referring to FIGS. 7 and 8, based on the above structure, each of the protruding ribs 32 extends into a respective notch 15. One of the light-emitting elements 4 is mounted on a portion of the protruding rib 32 extending into the notch 15. In this arrangement, the light-emitting elements 4 are located within and outside the rotation range of the impeller F. Therefore, in addition to the cooling function as originally provided, the light-emitting elements 4 are not completely blocked by other structure in the axial direction. With the provision of the light-guiding members 5, the light of the light-emitting elements 4 can transmit through the light-guiding members 5 to thereby generate a halo-like pattern or different colors of light for decoration purposes.

Figure 9:
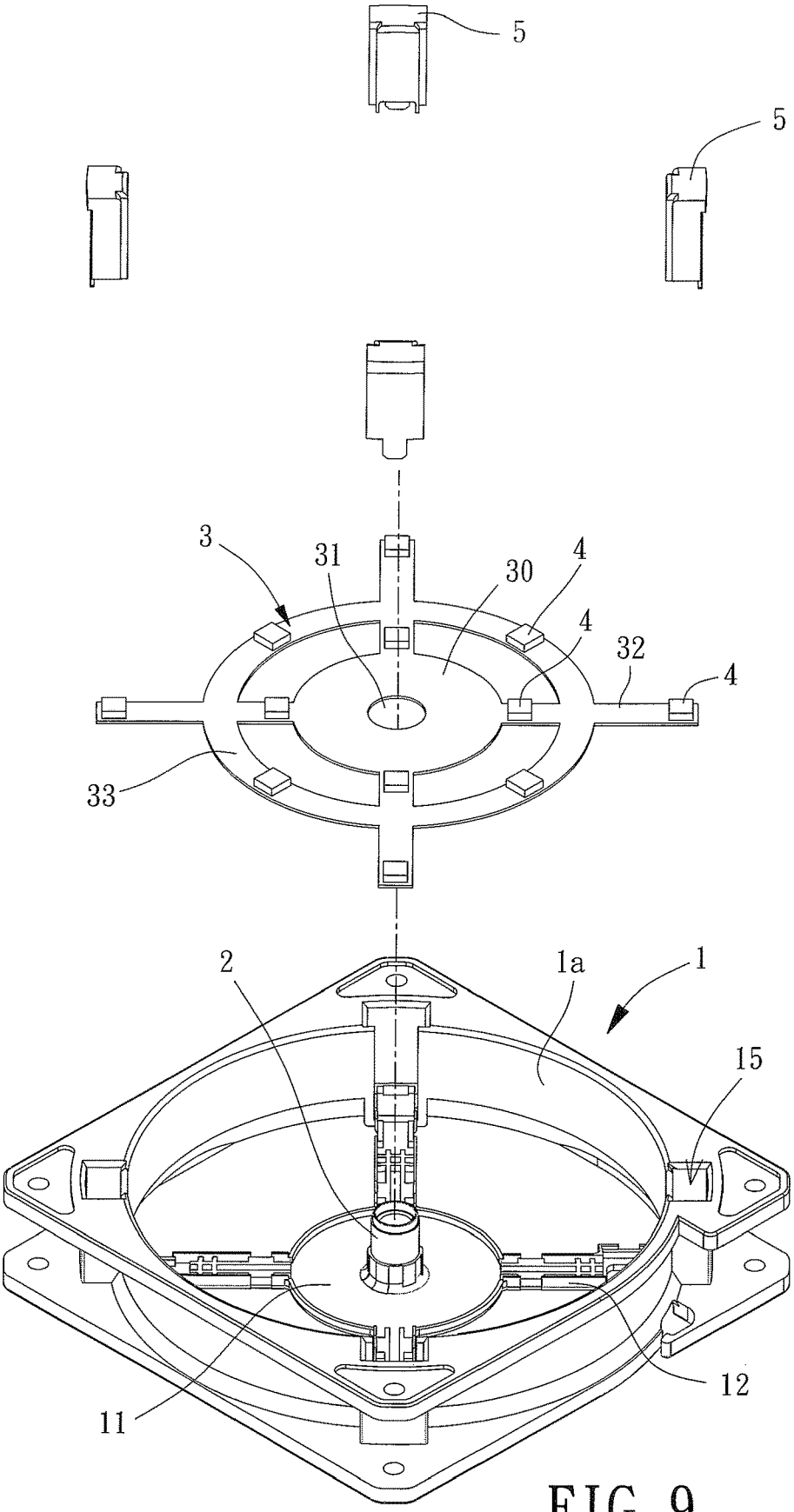
FIG. 9 is a partially-exploded, perspective view of a fan frame of a fourth embodiment according to the invention.

FIG. 9 shows a fan frame of a fourth embodiment according to the invention. The fourth embodiment of the invention is substantially the same as but differs from the third embodiment in that the circuit board 3 is integrally formed with at least one outer rib 33. Each outer rib 33 is located between two adjacent protruding ribs 32 and is mounted with the light-emitting element 4.

Referring to FIG. 9, based on the above structure, each of the at least one outer rib 33 is located between two adjacent protruding ribs 32. In this regard, each of the protruding ribs 32 is mounted with at least one light-emitting element 4, and each outer rib 33 is also mounted with at least one light-emitting element 4. As a result, the light-emitting elements 4 are located within and outside the rotation range of the impeller F (as shown in FIG. 7). Therefore, in addition to the cooling function as originally provided, the light-emitting elements 4 are not completely blocked by other structure in the axial direction. With the provision of the light-guiding members 5, the light of the light-emitting elements 4 can transmit through the light-guiding members 5 to thereby generate a halo-like pattern or different colors of light for decoration purposes.

In summary, with the fan frame and the fan including the same according to the invention, the circuit board is integrally formed with a plurality of protruding ribs extending outwardly of the body and at least one outer rib. Based on this, each of the protruding ribs is mounted with at least one light-emitting element, and each outer rib is also mounted with at least one light-emitting element. Thus, the light-emitting elements are not completely blocked by other structure in the axial direction irrespective of whether the light-emitting elements are located within or outside the rotation range of the impeller. Particularly, the light-emitting elements can render different glaring visual effects during the rotation of the impeller in addition to the cooling function as originally provided. Furthermore, with the provision of the light-guiding members, a halo-like pattern or different colors of light are generated for decoration purposes. This can not only bring more businesses to the industry but also provide a higher utility and an aesthetic effect.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A fan frame comprising:

a housing including a base and a plurality of connection members located between the base and a peripheral wall of the housing;

a shaft tube mounted on the base;

a circuit board mounted in the housing and including a body having a through-hole, wherein the circuit board is fit around the shaft tube via the through-hole and is integrally formed with a plurality of protruding ribs and at least one outer rib, wherein each of the plurality of protruding ribs is aligned with a respective one of the plurality of connection members, and wherein each of the at least one outer rib is located between two adjacent ones of the plurality of protruding ribs, and wherein each of the at least one outer rib has two ends, wherein one of the two ends connects to an adjacent one of the plurality of protruding ribs; and a plurality of light-emitting elements mounted on a surface of each of the plurality of protruding ribs facing away from the plurality of connection members and a surface of each of the at least one outer rib facing away from the plurality of connection members.

2. The fan frame as claimed in claim 1, wherein the at least one outer rib forms at least one ring.

3. The fan frame as claimed in claim 1, wherein each of the plurality of protruding ribs has a length smaller than or equal to a length of the respective one of the plurality of connection members.

4. The fan frame as claimed in claim 1, wherein each of the plurality of protruding ribs has a width smaller than or equal to a width of the respective one of the plurality of connection members.

5. The fan frame as claimed in claim 1, wherein a quantity of the plurality of protruding ribs is smaller than or equal to a quantity of the plurality of connection members.

6. The fan frame as claimed in claim 1, wherein the plurality of light-emitting elements is mounted on the circuit board at regular intervals.

7. The fan frame as claimed in claim 1, wherein the plurality of light-emitting elements includes at least two kinds of colors of light sources.

8. The fan frame as claimed in claim 1, wherein the plurality of light-emitting elements includes a plurality of light-emitting diodes, and wherein the plurality of light-emitting diodes includes three primary colors of light comprising red, green and blue colors.

9. The fan frame as claimed in claim 1, wherein the circuit board and the base are integrally formed with each other.

10. The fan frame as claimed in claim 1, wherein the circuit board includes a motor drive control circuit and a light-emitting diode (LED) control circuit.

11. A fan frame comprising:

a housing including a plurality of first coupling portions on a side thereof;

a base including a plurality of connection members, wherein each of the plurality of connection members includes a free end having a second coupling portion coupled with a respective one of the plurality of first coupling portions;

a circuit board including a body and integrally formed with a plurality of protruding ribs and at least one outer rib, wherein each of the plurality of protruding ribs is aligned with a respective one of the plurality of connection members, and wherein each of the at least one outer rib is located between two adjacent ones of the plurality of protruding ribs, and wherein each of the at least one outer rib has two ends, wherein one of the two ends connects to an adjacent ones of the plurality of protruding ribs; and a plurality of light-emitting elements mounted on a surface of each of the plurality of protruding ribs facing away from the plurality of connection members and a surface of each of the at least one outer rib facing away from the plurality of connection members.

12. The fan frame as claimed in claim 11, wherein each of the plurality of first coupling portions is an engaging hole, and wherein each of the plurality of second coupling portions is an engaging peg.

13. The fan frame as claimed in claim 11, wherein each of the plurality of first coupling portions is an engaging peg, and wherein each of the plurality of second coupling portions is an engaging hole.

14. The fan frame as claimed in claim 11, further comprising a plurality of fasteners, wherein each of the plurality of first coupling portions is in a form of a hole, wherein each of the plurality of second coupling portions is also in a form of a hole, and wherein the plurality of fasteners respectively extends through the plurality of first coupling portions and the plurality of second coupling portions.

15. The fan frame as claimed in claim 11, wherein the at least one outer rib forms at least one ring.

16. The fan frame as claimed in claim 11, wherein each of the plurality of protruding ribs has a length smaller than or equal to a length of the respective one of the plurality of connection members.

17. The fan frame as claimed in claim 11, wherein each of the plurality of protruding ribs has a width smaller than or equal to a width of the respective one of the plurality of connection members.

18. The fan frame as claimed in claim 11, wherein a quantity of the plurality of protruding ribs is smaller than or equal to a quantity of the plurality of connection members.

19. The fan frame as claimed in claim 11, wherein the plurality of light-emitting elements is mounted on the circuit board at regular intervals.

20. The fan frame as claimed in claim 11, wherein the plurality of light-emitting elements includes at least two kinds of colors of light sources.

21. The fan frame as claimed in claim 11, wherein the plurality of light-emitting elements includes a plurality of light-emitting diodes, and wherein the plurality of light-emitting diodes includes three primary colors of light comprising red, green and blue colors.

22. The fan frame as claimed in claim 11, wherein the circuit board includes a motor drive control circuit and a light-emitting diode (LED) control circuit.

23. A fan comprising: the fan frame as claimed in claim 1; and an impeller which is transparent or translucent.

24. A fan comprising:

the fan frame as claimed in claim 11; and an impeller which is transparent or translucent.

* * * * *